US005537136A

United States Patent [19]

Brandon et al.

[11] Patent Number: 5,537,136

[45] Date of Patent: Jul. 16, 1996

[54] INK JET CARTRIDGE INCLUDING FILTER INSERTS

[75] Inventors: Fred Y. Brandon, Lexington; Curtis R. Droege, Richmond; James H. Powers, Lexington, all of Ky.

[73] Assignee: Lexmark International, Inc., Lexington, Ky.

[21] Appl. No.: 163,648

[22] Filed: Dec. 7, 1993

[51] Int. Cl.[6] ..... B41J 2/175

[52] U.S. Cl. ..... 347/87; 347/93

[58] Field of Search ..... 347/86, 87, 93; 210/482, 477, 495, 471, 462, 459, 451, 449; 346/75

[56] References Cited

U.S. PATENT DOCUMENTS

| | | | |
|---|---|---|---|
| 1,898,382 | 2/1933 | Mullaney | 210/462 |
| 3,608,736 | 9/1971 | Wong | 210/477 |
| 3,708,118 | 2/1973 | Keur | 346/75 |
| 4,329,698 | 5/1982 | Smith | 346/140 R |
| 4,771,295 | 9/1988 | Baker et al. | 346/1.1 |
| 4,931,811 | 6/1990 | Cowger et al. | 346/140 R |

FOREIGN PATENT DOCUMENTS

| | | | |
|---|---|---|---|
| 0574888A2 | 12/1993 | European Pat. Off. . | |
| 0603902A2 | 6/1994 | European Pat. Off. . | |
| 33154 | 2/1984 | Japan | 347/93 |
| 262653 | 12/1985 | Japan | 347/93 |
| 214961 | 9/1987 | Japan | 347/93 |
| 133747 | 5/1989 | Japan | 347/93 |
| 162321 | 6/1993 | Japan | 347/93 |

*Primary Examiner*—N. Le

*Attorney, Agent, or Firm*—John J. McArdle, Jr.; Ronald K. Aust

[57] ABSTRACT

An ink jet printer cartridge assembly including a cartridge body with at least one ink chamber from which ink flows to a print head. A standpipe in the ink chamber includes an opening therethrough for the flow of ink to the print head, and a filter cap is secured on the top of the standpipe to limit the introduction of air bubbles and particulate matter in the flow of ink toward the print head. The filter cap includes a mesh material formed into a dome-shaped configuration and an elastomeric material molded about the periphery of the mesh portion, with the elastomeric material being received around the top portion of the standpipe.

17 Claims, 1 Drawing Sheet

INK JET CARTRIDGE INCLUDING FILTER INSERTS

BACKGROUND OF THE INVENTION

This invention relates generally to ink jet print heads and more particularly concerns such a print head which includes a filter to prevent the introduction of particulate matter and air bubbles into the flow path to the print head nozzles.

In an ink jet print head, liquid ink is contained in the interior of an ink chamber in a print head body, usually retained within a foam material. Such print heads combine ink storage and drop ejection functions in a single package. The print head includes an ink reservoir made up of one or more chambers containing ink-saturated porous material and a print element in which electronic and fluidic components that control the ejection of ink droplets reside. Interconnection between the ink reservoir and the print element is accomplished by an ink manifold. Filter/standpipe structures, one in each reservoir chamber for each color of ink, form a part of the ink manifold.

In the past, a fine mesh filter has been affixed to the entrance of each standpipe. The filter is in intimate contact with the porous reservoir material above the standpipe, which is typically a polyurethane foam. The filter/standpipe assembly performs a number of essential functions. Since the porous reservoir material is chosen to be deformable, the filter/standpipe assembly compresses the reservoir material near the filter. This compression insures intimate contact between the filter and the reservoir material. The filter also acts as a capillary drain, allowing ink passage upon demand but preventing air passage into the standpipe. This function is enhanced by the intimate contact between the filter and the reservoir material. A proper balance between filter pore size and reservoir material compression insures a high reservoir drainage efficiency. Finally, the most obvious function of the filter is to prevent passage of contaminant particles into the print element. If contaminant particles enter the print element, they can block the tiny ink channels found in the high resolution print elements.

Foremost among the requirements of an acceptable filter bond to the standpipe is that it extend around the entire perimeter of the contact line between the filter and the standpipe. This is made difficult by the usual difference in material properties between the filter and the standpipe. In one prior ink cartridge, for example, the filter is a stainless steel wire mesh while the standpipe is a polyphenylene oxide resin. Failure to achieve a complete bond around the periphery of this standpipe with the mesh leaves a pathway for the passage of air and contaminant particles into the standpipe.

The usual technique for attaching the mesh filter onto the plastic standpipe structure is heat stake welding. This method has several drawbacks in a high volume manufacturing environment. Foremost among these drawbacks is the difficulty in reliably achieving a suitable bond between the filter and the standpipe. The heat stake welding process can be made to work reliably only after extensive optimization of multiple operating parameters. A second drawback of heat stake welding is its tendency under certain conditions to generate particulate contamination.

One alternative to heat stake welding is adhesive bonding of the mesh to the standpipe. Although this method circumvents the problem of particulate generation, the process still requires extensive optimization. In addition, the time and temperature required to cure adhesives render this alternative unattractive compared to heat stake welding.

It is an objective of the present invention to provide a cartridge assembly of the foregoing type with an improved filter/standpipe arrangement.

This objective is met in accordance with the present invention by the provision of a self-sealing elastomer filter insert which is received over the top of a standpipe in an ink chamber in an ink jet cartridge.

Advantageously, the provision of such a self-sealing elastomer filter insert eliminates the need to achieve a permanent bond between the filter and the standpipe since the filter insert seals itself against the standpipe wall.

As a further advantage, the potential for particulate generation in the assembly process is eliminated, and the assembly operation is greatly simplified, leading to more reliable assembly.

Further, contact between the porous reservoir material and the filter is, in the present form of the invention, additionally enhanced by "coining" the filter material into a domed shape. This insures adequate contact between the filter and the reservoir material and enhances reservoir draining efficiency.

Still further, the self-sealing elastomer filter may be much more easily handled than a mesh filter element during assembly of the print head.

DETAILED DESCRIPTION

Figure 1:
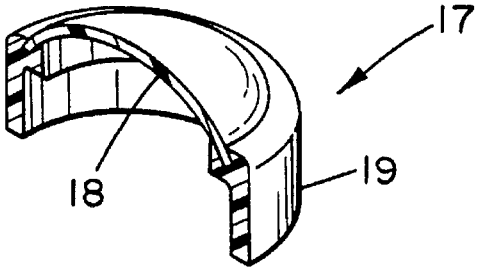
FIG. 1 is a perspective, sectional view of a filter cap in accordance with the present invention.
Figure 2:
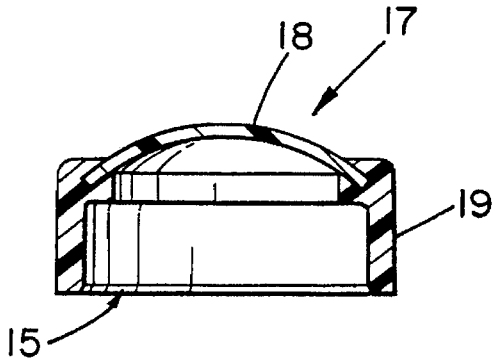
FIG. 2 is a cross-sectional view of the cap of FIG. 1.

With reference now to the figures, an ink jet print head cartridge 10 includes a cartridge body 11 containing an ink chamber substantially filled with a foam material 12. In use, ink in the ink-saturated porous material 12 is drawn from the ink chamber through the interior 13 of a standpipe portion 14 of the print head body 11 and an outlet 16 to an exit port (not shown) on the bottom 21 of the cartridge body through channels such as 20 in the lower portion of the cartridge body 11. The ink flows from the exit port into a manifold in a print head chip (not shown) from which it is subsequently drawn to nozzle chambers for ejection onto a print medium. As the ink is ejected from the print head, replacement ink is drawn out of the porous material 12 through the standpipe 14. The porous material in one form of cartridge is a reticulated polyetherpolyurethane foam such as Foamex Corp. SIF Felt No. 03Z70A0532.

Figure 3:
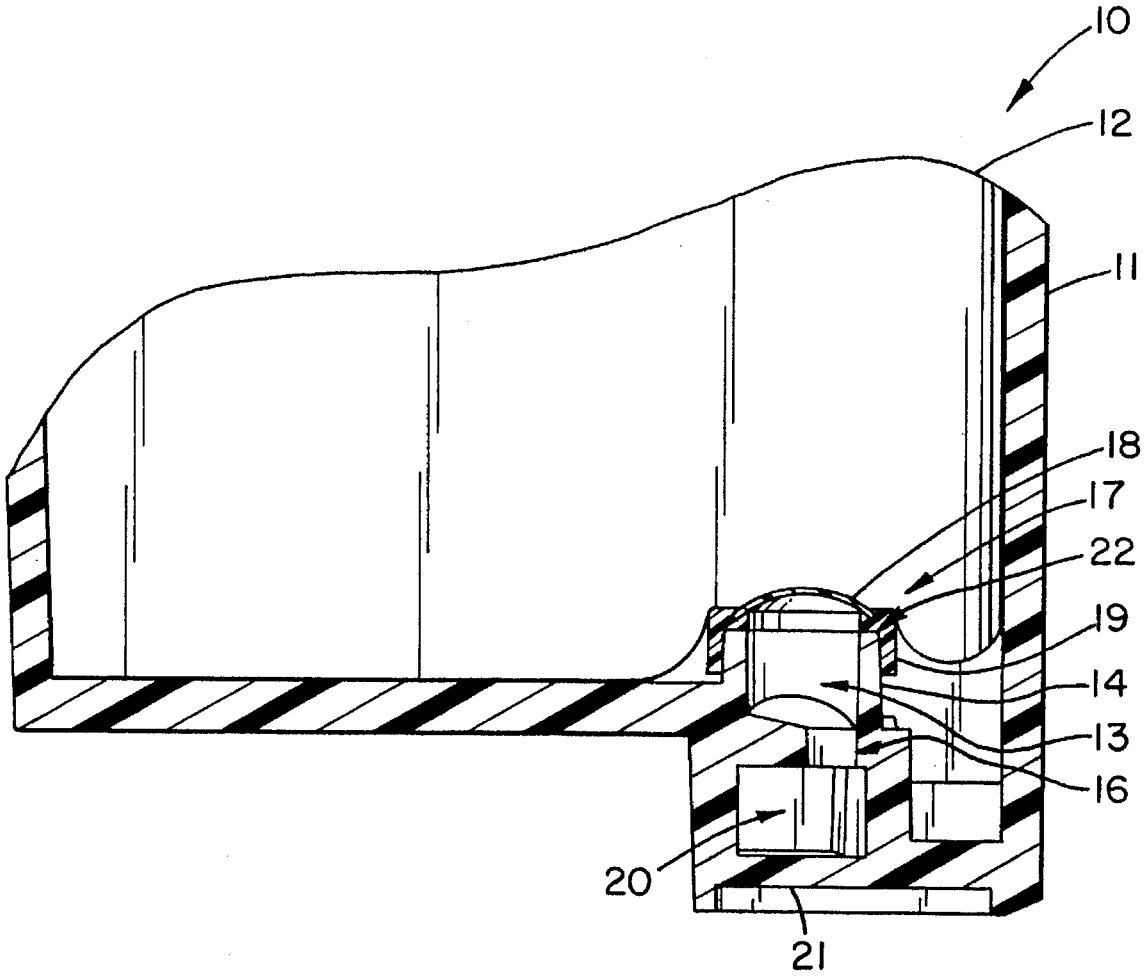
FIG. 3 is a sectional view of a portion of an ink jet print head cartridge assembly in accordance with the present invention.

Filter cap 17 is fitted onto the top of the standpipe 14 to enhance the flow of ink from the porous material 12 and to filter out air bubbles and particulate matter. The filter cap 17 is made up of a disk 18 of stainless steel mesh filter material, which is embossed into a domed shape. As shown in FIG. 3, the top of the domed mesh disk 18 presses into the foam material 12, making close contact therewith over the entire top surface of the disk. In the formation of the filter cap 17, the domed steel mesh filter material is placed into an injection mold, and an elastomeric material is injected into the mold, binding the mesh filter around its edge.

Elastomeric material 19 extends downwardly from the filter mesh to be received around the exterior of the top of the standpipe 14. The generally circular bottom edge of the elastomeric material 19 includes a chamber 15 to facilitate initial placement of the filter cap on the standpipe 14. This placement is further aided by rounding of the outside diameter corner 22 of the top of the standpipe 14. After the filter cap 17 is positioned on the standpipe 14, the filter cap 17 is moved downwardly onto the standpipe 14 to the position shown in FIG. 3. The seal between the apron of elastomeric material 19 and the outside of the standpipe 14 is improved by a gradually increased outside diameter of the standpipe 14 as the filter cap 17 moves downward. Filter cap 17 is fitted over the standpipe 14 during the assembly of the cartridge 10 before the foam material 12 is inserted into the cartridge body 11.

While one reservoir chamber in the standpipe 14 is shown in FIG. 3, there may be provided additional chambers, standpipes and filter caps for additional colors of ink. The disk 18 is presently preferred to be made of a dynamesh filter medium rated at 20 microns, available from Fluid Dynamics Corp., Deland, Fla. The elastomeric material 18 is preferably Santoprene 201–73, from Advanced Elastomer Systems, St. Louis, Mo.

We claim:

1. A cartridge assembly for an ink jet printer comprising a cartridge body defining an ink reservoir, a print head secured on the cartridge body in communication with the ink reservoir so that ink in the ink reservoir can flow into the prit head, the cartridge body including a standpipe portion in the ink reservoir through which ink can flow to the print head, and a unitary filter cap for the standpipe portion including a filter portion and an elastomeric base portion surrounding the filter portion and fixed thereto, the base portion being shaped to be received in a snug fit on the standpipe portion of the cartridge body in the ink reservoir;

wherein the elastomeric base portion includes a substantially cylindrical portion overlying a portion of the standpipe portion of the cartridge body extending from a top of the standpipe portion; and the portion of the standpipe portion of the cartridge body having the substantially cylindrical portion of the elastomeric base overlying it increases in diameter from the top at least until the cylindrical portion of the elastomeric base overlying it terminates to insure a sealing between the elastomeric base and the standpipe portion of the cartridge body.

2. The cartridge assembly of claim 1 in which the base portion of the unitary filter cap and the top of the standpipe portion of the cartridge body are substantially annular.

3. The cartridge assembly of claim 1, wherein the filter portion of the filter cap is a mesh element around which the elastomeric base has been molded.

4. The cartridge assembly of claim 3 in which the mesh element is has a generally convex shape.

5. The cartridge assembly of claim 1, wherein the filter portion of the unitary filter cap is a metallic mesh element having a peripheral edge around which the elastomeric base portion has been molded and is integral therewith.

6. The cartridge assembly of claim 5 in which the metallic mesh element is preformed in a generally convex shape and extends above the elastomeric material and the standpipe portion of the cartridge body.

7. The cartridge assembly of claim 1 in which the base portion of the unitary filter cap maintains the filter portion of the unitary filter cap in spaced relation above the standpipe portion.

8. The cartridge assembly of claim 1 in which the substantially cylindrical portion of the base portion of the unitary filter cap has its inner surface in continuous engagement with the standpipe portion to insure a sealing relation with the standpipe portion.

9. The cartridge assembly of claim 1 in which the filter element is a metallic mesh element.

10. The cartridge assembly of claim 1 wherein the filter portion of the unitary filter cap has a diameter that does not exceed the diameter of the standpipe portion.

11. A cartridge assembly for an ink jet printer comprising a cartridge body defining an ink reservoir, a print head secured on the cartridge body in communication with the ink reservoir so that ink in the ink reservoir can flow into the print head, the cartridge body including a standpipe portion in the ink reservoir through which ink can flow to the print head, and a filter cap for the standpipe portion including a filter portion and a base portion surrounding the filter portion, the base portion being shaped to be received on the standpipe portion of the cartridge body in the ink reservoir, the standpipe portion of the cartridge body having a top with a first shape, the base portion of the filter cap being of a size and shape to be snugly received on the top of the standpipe portion, the base portion of the filter cap and the top of the standpipe portion of the cartridge body being substantially annular, the base portion of the filter cap being an elastomeric material, the filter portion of the filter cap being a mesh element around which the elastomeric material has been molded, the elastomeric material overlying a portion of the standpipe portion of the cartridge body extending from the top of the standpipe portion, and the portion of the standpipe portion of the cartridge body having the elastomeric material overlying it has its outer diameter increase from the top for at least the portion of the standpipe portion of the cartridge body having the elastomeric material overlying it to insure a sealing relation between the elastomeric material and the standpipe portion of the cartridge body.

12. The ink cartridge of claim 11, wherein said filter portion has a dome-shaped outer surface.

13. A cartridge assembly for an ink jet printer comprising a cartridge body defining an ink reservoir, a print head secured on the cartridge body in communication with the ink reservoir so that ink in the ink reservoir can flow into the print head, the cartridge body including a standpipe portion in the ink reservoir through which ink can flow to the print head, and a filter cap for the standpipe portion including a filter portion and a base portion surrounding the filter portion, the base portion being shaped to be received in the standpipe portion of the cartridge body in the ink reservoir, the standpipe portion of the cartridge body having a top with a first shape, the base portion of the filter cap being of a size and shape to be snugly received on the top of the standpipe portion, and the first shape of the top of the standpipe portion including an increasing outer diameter of the standpipe portion in a downward direction from the top for at least the portion of the standpipe portion that the base portion of the filter cap overlies.

14. The ink cartridge of claim 13, wherein said filter portion has a dome-shaped outer surface.

15. An ink cartridge for an ink jet printer comprising:

a cartridge body which includes an ink chamber, a standpipe in the chamber having an opening therethrough, the standpipe having a top portion, and an exit port in communication with the opening in the standpipe so that ink can flow from the ink chamber through the standpipe to the exit port; and a filter cap secured on the standpipe including a filter element having a periphery and an elastomeric material molded about the periphery of the filter element, the elastomeric material being received on the top portion of the standpipe, the elastomeric material of the filter cap overlying the standpipe from the top portion of the standpipe to the termination of the elastomeric material in a sealing relation, and at least the portion of the standpipe having the elastomeric material of the filter cap overlying it has its outer diameter increase from the top portion to form the sealing relation between the elastomeric material and the standpipe.

16. The ink cartridge of claim 15 in which at least the portion of the standpipe having the elastomeric material of the filter cap overlying it is substantially annular.

17. The ink cartridge of claim 15 wherein said filter element has a dome-shaped outer surface.

* * * * *